US005630390A

United States Patent [19]

Tsunoda et al.

[11] Patent Number: 5,630,390

[45] Date of Patent: May 20, 1997

[54] COMPACT OUTBOARD ENGINE STRUCTURE

[75] Inventors: Masaki Tsunoda; Kouji Koishikawa; Hitoshi Suzuki, all of Wako, Japan

[73] Assignee: Honda Giken Kogyo Kabushiki Kaishi, Tokyo, Japan

[21] Appl. No.: 645,791

[22] Filed: May 14, 1996

[30] Foreign Application Priority Data

May 18, 1995 [JP] Japan ..... 7-120260

[51] Int. Cl.[6] ..... F02F 7/00

[52] U.S. Cl. ..... 123/195 P; 123/195 E; 123/196 W; 123/184.34

[58] Field of Search ..... 123/195 P, 196 W, 123/195 E, 54.4, 184.34; 440/900

[56] References Cited

U.S. PATENT DOCUMENTS 5,553,586 9/1996 Koishikawa et al. ..... 123/195 P

FOREIGN PATENT DOCUMENTS 6-264757 9/1994 Japan .

*Primary Examiner*—Noah P. Kamen

*Attorney, Agent, or Firm*—Nikaido Marmelstein Murray & Oram LLP

[57] ABSTRACT

An upper intake pipe and a lower intake pipe interconnecting a left bank and a throttle body are disposed along a left side of a V-shaped multi-cylinder engine having a vertically placed crankshaft. The lower intake pipe is disposed by utilizing a waste space which is defined between a starter motor and an oil filter, while the oil filter is disposed by utilizing a waste space which is defined between the upper and lower intake pipes. Thus, it is possible to rationally dispose the intake pipes and other auxiliaries on a side of an engine block to reduce the size of the engine for the outboard engine system.

11 Claims, 7 Drawing Sheets

COMPACT OUTBOARD ENGINE STRUCTURE

BACKGROUND OF THE INVENTION

1. Field of the Invention

The present invention relates to an engine for an outboard engine system. An engine block subassembly supports a crankshaft in a vertical attitude, and has a plurality of cylinders formed therein into a V-shape to open rearwardly from the crankshaft. A cylinder head is coupled to a rear end of the engine block subassembly. A throttle body is disposed in front of the engine block subassembly. A plurality of intake pipes extend from the throttle body through left and right opposite sides of the engine block subassembly and are connected to the cylinder head.

2. Description of the Art

An engine for an outboard engine system is already known from Japanese Patent Application Laid-open No. 264757/94.

The above known engine includes the plurality of intake pipes extending along the left and right opposite sides of the engine block. Therefore, if the intake pipes and other auxiliaries are not rationally disposed, the size of the engine is increased, and there is a possibility that handling during steering or tilting-up is obstructed.

SUMMARY OF THE INVENTION

It is an object of the present invention to reduce the size of the engine for an outboard engine system by rationally disposing the intake pipes and other auxiliaries on the side of the engine block.

According to a first aspect of the present invention, there is provided an engine for an outboard engine system, including an engine block subassembly for supporting a crankshaft in a vertical attitude, and having a plurality of cylinders formed therein into a V-shape to open rearwardly from the crankshaft. A cylinder head is coupled to a rear end of the engine block subassembly. A throttle body is disposed in front of the engine block subassembly. A plurality of intake pipes extend from the throttle body through left and right opposite sides of the engine block subassembly and are connected to the cylinder head. The engine further includes a starter motor mounted at a lower portion of the engine block subassembly on one side thereof for driving the crankshaft. An oil filter is mounted above the starter motor. At least one of the plurality of intake pipes is disposed such as to extend between the starter motor and the oil filter.

With the first aspect of the present invention, the intake pipes can be disposed by effectively utilizing a wasted space defined between the oil filter and the starter motor, thereby contributing to a reduction in size of the engine for the outboard engine system.

According to a second aspect of the invention, there is provided an engine for an outboard engine system, including an engine block subassembly for supporting a crankshaft in a vertical attitude, and having a plurality of cylinders formed therein into a V-shape to open rearwardly from the crankshaft. A cylinder head is coupled to a rear end of the engine block subassembly. A throttle body is disposed in front of the engine block subassembly. A plurality of intake pipes extend from the throttle body through left and right opposite sides of the engine block subassembly and are connected to the cylinder head. The engine further includes an oil filter which is disposed between two adjacent intake pipes of the plurality of intake pipes disposed on one side of the engine block subassembly.

With the second aspect of the present invention, a wasted space defined between the two intake pipes can be effectively utilized for disposition of the oil filter, thereby contributing to a reduction in size of the engine for the outboard engine system.

In addition to the first and second aspects of the invention, according to a third aspect, the engine further includes an under-case portion for covering a lower half of the engine block subassembly. An engine cover is detachably coupled to an upper edge of the under-case portion to cover an upper half of the engine block subassembly. The oil filter is detachably mounted at a location higher than the upper edge of the under-case portion.

With the third aspect of the present invention, when the engine cover is removed from the under-case portion for maintenance of the oil filter, the oil filter can be easily detached without being impeded by the under-case portion.

In addition to the first through third aspects of the invention, according to a fourth aspect, the plurality of cylinders are vertically superposed and alternately distributed on left and right opposite sides of the cylinder block subassembly. The second cylinder from the bottom is formed in the one side of the engine block subassembly.

With the fourth aspect of the present invention, as compared with the case where the oil filter is disposed on the other side of the cylinder block subassembly on which the lowermost cylinder is disposed, the position of the oil filter can be established at a higher level, and maintenance work can be further facilitated.

In addition to the first through fourth aspects of the invention, according to a fifth aspect, the engine further includes an oil pump disposed below the second cylinder from the bottom for supplying a lubricating oil to the oil filter.

With the fifth aspect of the present invention, the oil pump can be disposed by effectively utilizing a wasted space defined below the second cylinder.

According to a sixth aspect, there is provided an engine for an outboard engine system including an engine block subassembly for supporting a crankshaft in a vertical attitude, and having a plurality of cylinders formed therein into a V-shape to open rearwardly from the crankshaft. A cylinder head is coupled to a rear end of the engine block subassembly. A throttle body is disposed in front of the engine block subassembly. A plurality of intake pipes extend from the throttle body through left and right opposite sides of the engine block subassembly and are connected to the cylinder head. The engine further includes an under-case portion for covering a lower half of the engine block subassembly. An engine cover is detachably coupled to an upper edge of the under-case portion to cover an upper half of the engine block subassembly. An oil filter is detachably mounted at a location higher than the upper edge of the under-case portion on one side of the engine block subassembly and higher than the lowermost intake pipe disposed on the one side of the engine block subassembly.

With the sixth aspect of the present invention, the oil filter can be disposed at a higher location than previously placed, and when the engine cover is removed from the under-case portion for maintenance of the oil filter, the oil filter can be easily detached without being impeded by the under-case portion.

The above and other objects, features and advantages of the invention will become apparent from the following detailed description of a preferred embodiment taken in conjunction with the accompanying drawings.

DESCRIPTION OF THE PREFERRED EMBODIMENT

The present invention will now be described by way of a preferred embodiment with reference to the accompanying drawings.

Figure 1:
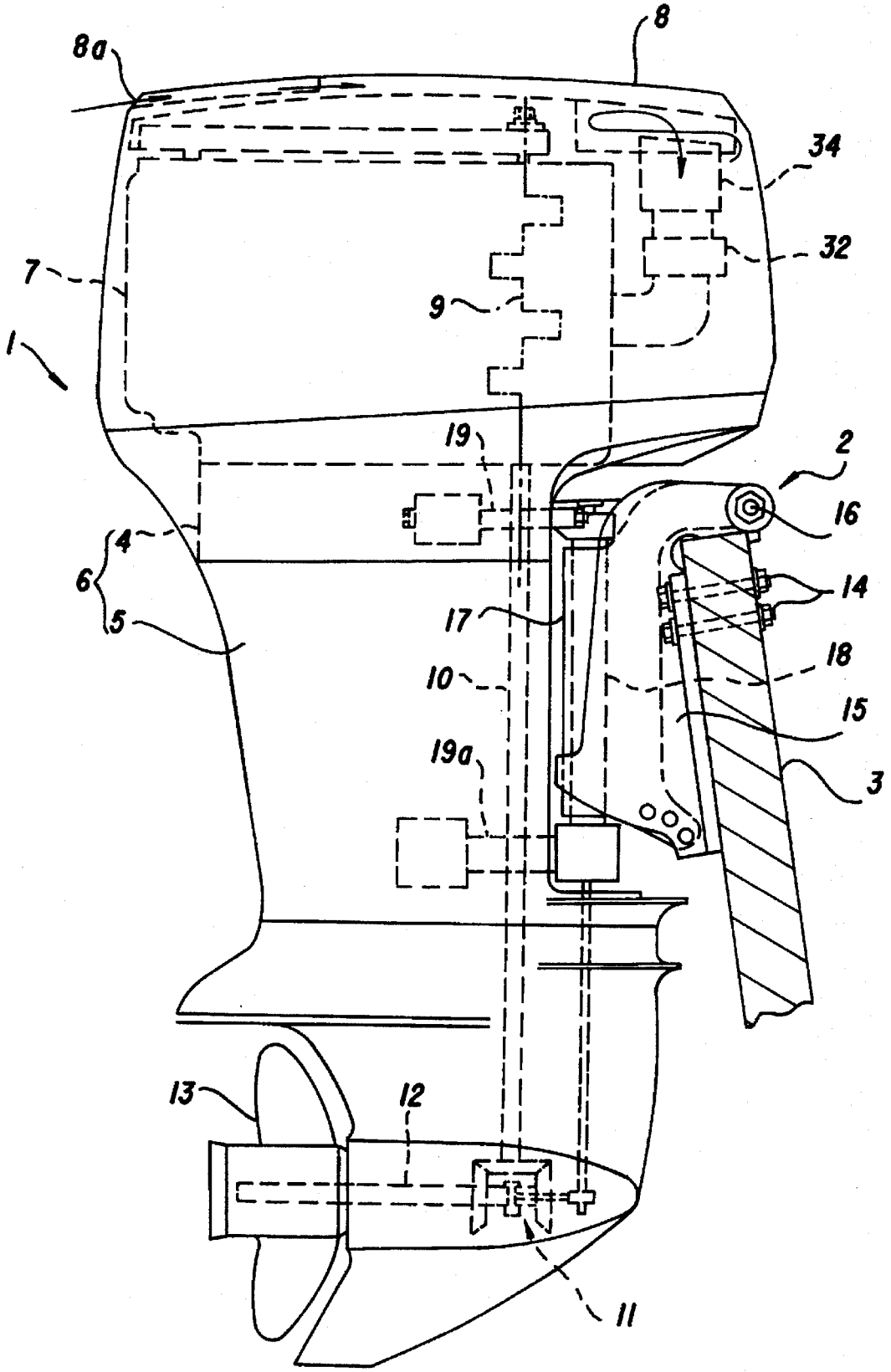
FIG. 1 is a side view of the entire arrangement of an outboard engine system.

FIG. 1 is a side view of the entire arrangement of an outboard engine system to which the present invention is applied. In FIG. 1, an outboard engine system body 1 is mounted to a stern 3 through a mounting device 2.

The engine system body 1 has an outboard engine system body case assembly 6 including an engine mount case 4 and an extension case 5. An engine 7 is mounted in an upper portion of the engine body case assembly 6. The engine 7 has a lower half which is covered with an under-cover case portion 6*a* which is connected to an upper end of the extension case 5. An upper half of the engine 7 is covered with an engine cover 8 which is detachably coupled to an upper edge of the under-case portion 6*a*. External air is introduced into the engine cover 8 through an air intake port 8*a*.

The engine 7 has a crankshaft 9 which is vertically directed. A driving shaft 10 is connected to the crankshaft 9 and extends downwardly within the engine system body case 6. The driving shaft 10 is connected at its lower end to a propeller shaft 12 through a forward and backward gear shift device 11. A propeller 13 is rotatively driven by engine power transmitted thereto via the crankshaft 9, the driving shaft 10, the forward and backward gear shift device 11 and the propeller shaft 12. The engine 7 will be described hereinafter in detail.

The mounting device 2 includes a pair of brackets 15 fixed to the stern 3 through bolts 14, and a swivel case 17 pivotally mounted to the bracket 15 through a tilting shaft 16 such that the swivel case 17 can be swung vertically. The tilting shaft 16 is mounted to a front end of the bracket 15 to extend laterally. A swivel shaft 18 is pivotally carried in a vertically directed attitude in the swivel case 17. The engine system body case assembly 6 is connected to the swivel shaft 18 through upper and lower connecting members 19 and 19*a*. Thus, the outboard engine system body case assembly 6 and thus the outboard engine system body 1 can be vertically swung about the tilting shaft 16 and can be leftwardly and rightwardly turned about an axis of the swivel shaft 18.

Figure 2:
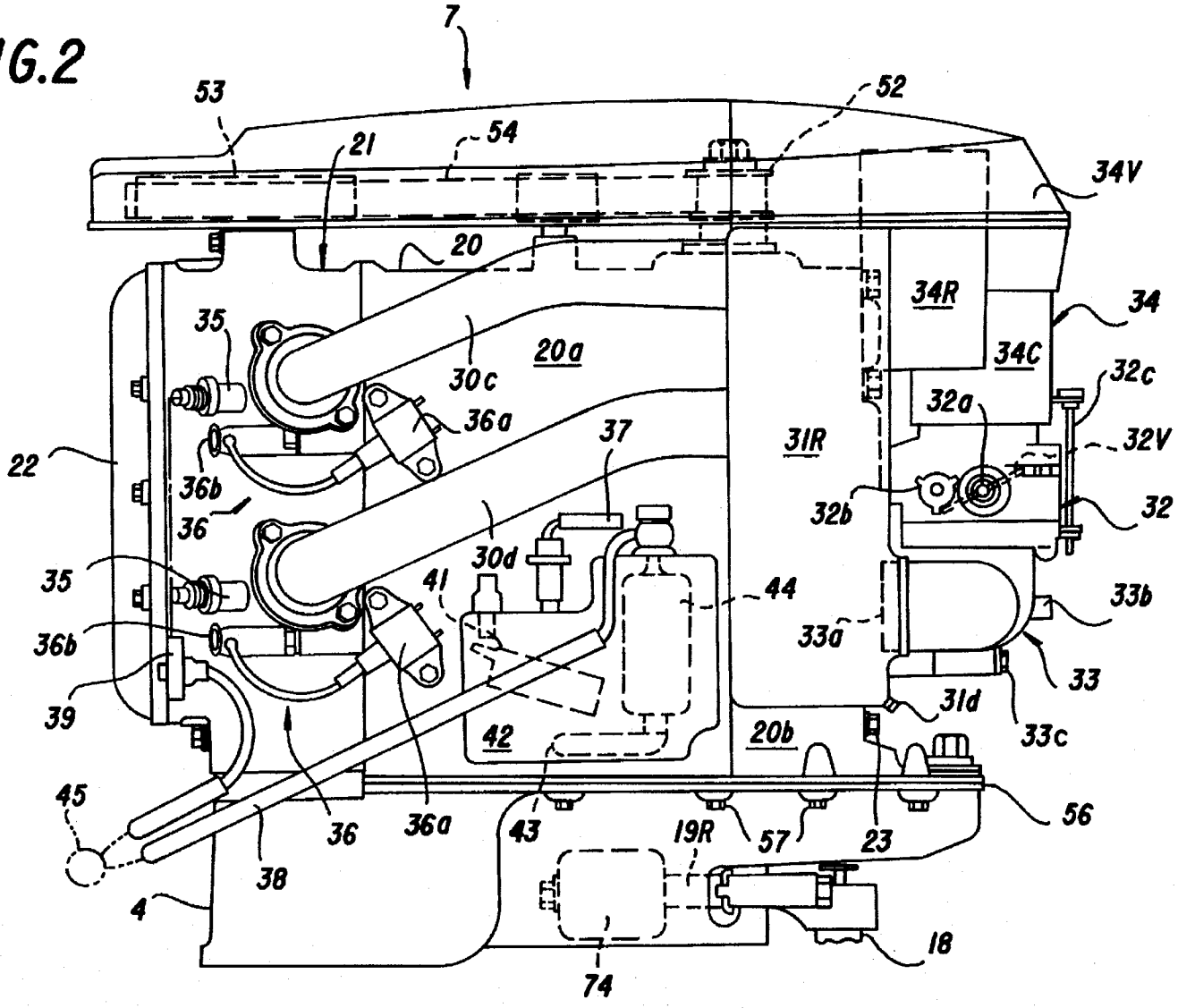
FIG. 2 is a right side view of an engine.
Figure 3:
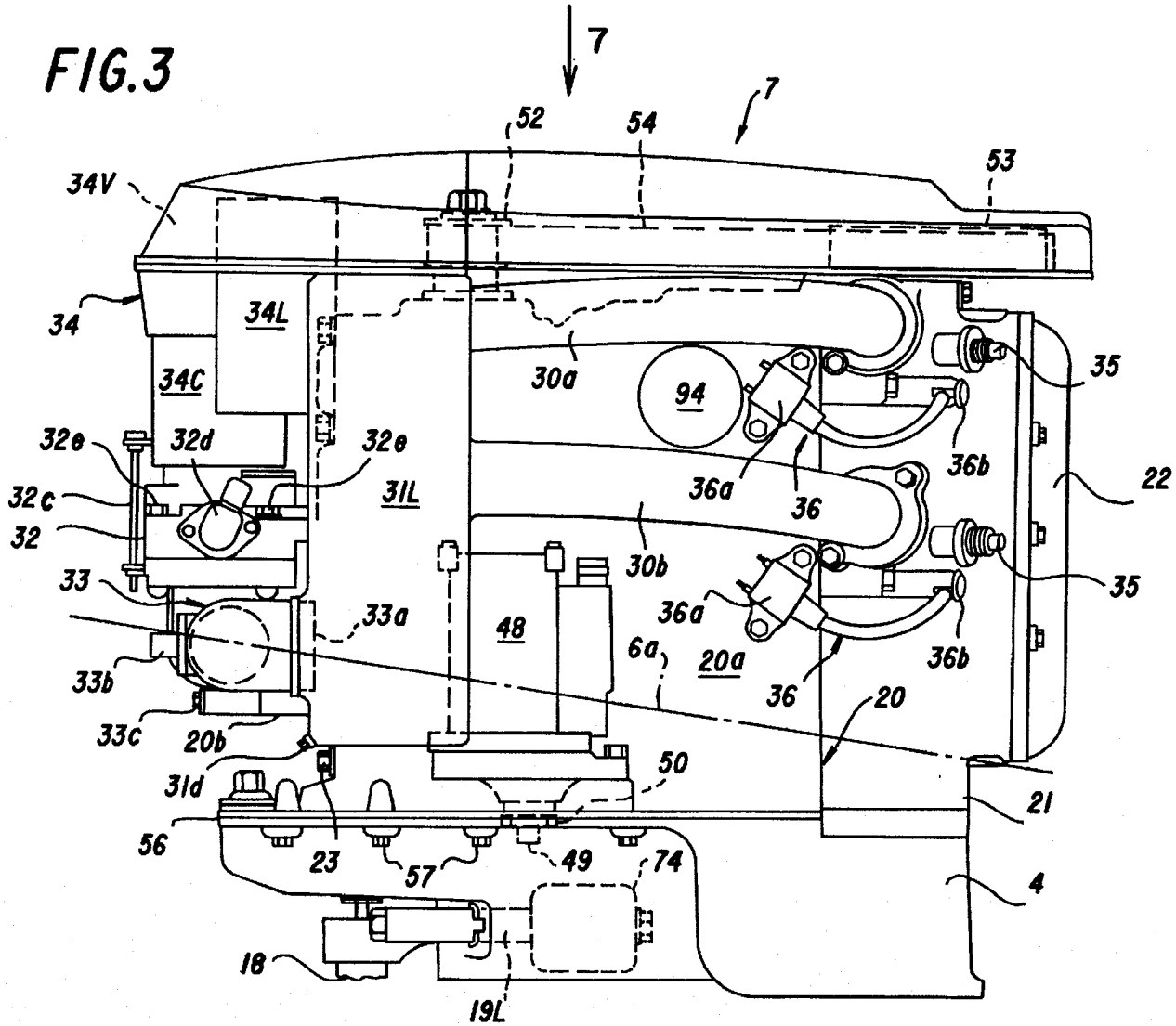
FIG. 3 is a left side view of the engine.
Figure 4:
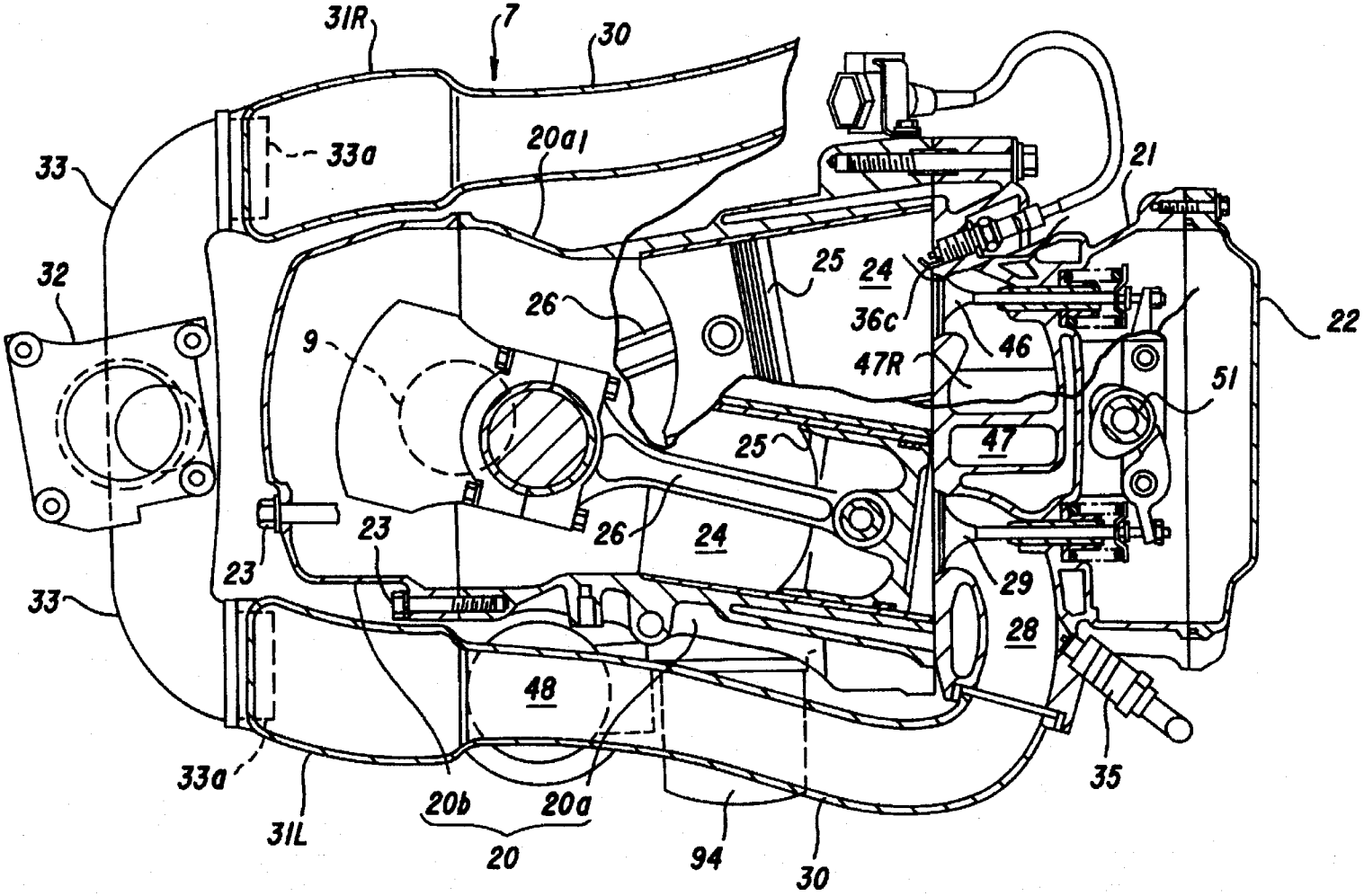
FIG. 4 is a transverse cross sectional view of the engine.

FIG. 2 is a right side view of the engine 7, FIG. 3 is a left side view of the engine 7, and FIG. 4 is a transverse cross sectional view of the engine 7. The term "left and right" of the engine or the outboard engine system refers to "left and right" as the outboard engine system mounted to the stern 3 in FIG. 1 is viewed forwardly from the rear (i.e., rightwardly from the left of FIG. 1).

A body of the engine 7 is composed of an engine block subassembly 20, a cylinder head 21, a cylinder head cover 22 and the like. The engine block subassembly 20 is formed by integrally fastening a cylinder block 20*a* integrally provided with a skirt portion 20*a*1 (see FIG. 4) forming a half of a crankcase chamber, to a remaining crankcase portion 20*b* by bolts 23. Two sets of pairs of cylinders 24, 24 are vertically disposed in a laterally V-shape within the engine block subassembly 20. That is, the engine 7 is a V-shaped 4-cylinder and 4-cycle engine, in which pistons 25 are connected to the single vertically directed crankshaft 9 through connecting rods 26.

Figure 5:
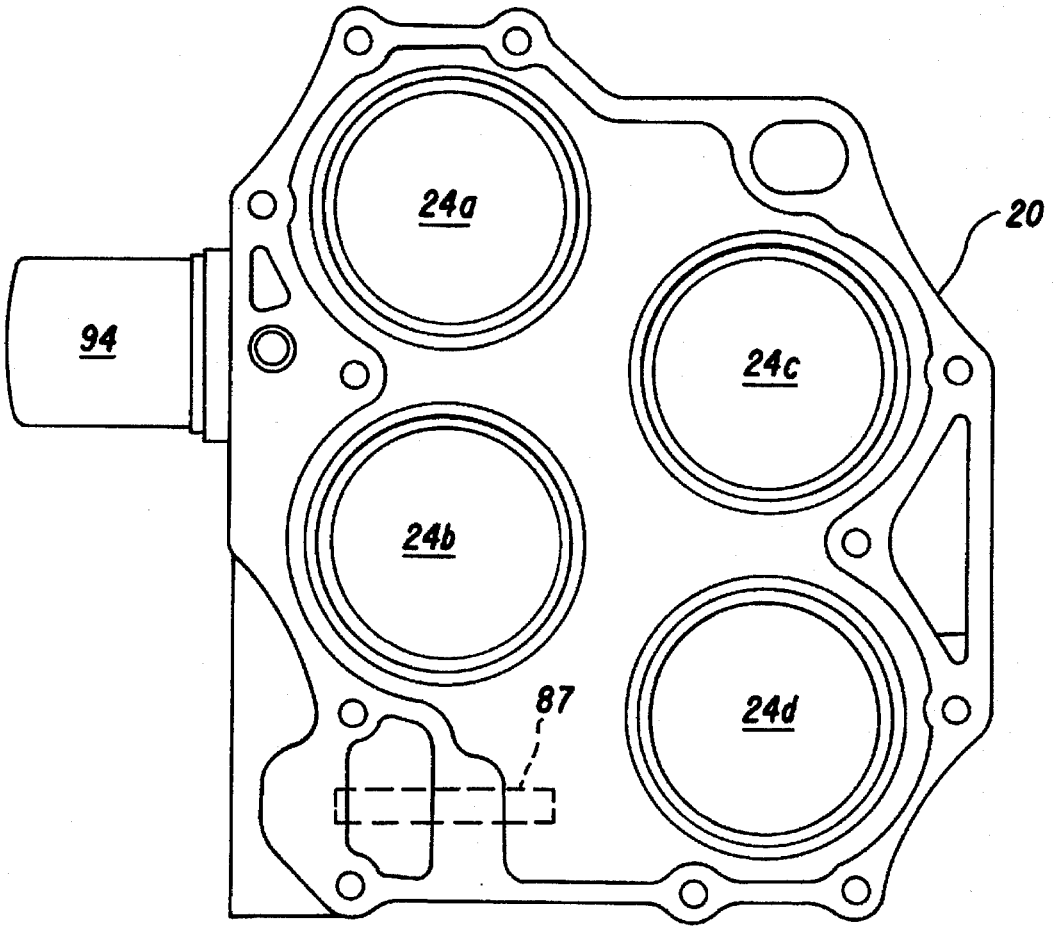
FIG. 5 is a view of an end of an engine block subassembly adjacent a cylinder head.

FIG. 5 is a view of an end of the engine block subassembly 20 adjacent the cylinder head 21. As can be seen from FIG. 5, the cylinders 24 are a set of upper and lower cylinder 24*a* and 24*b* arranged on a left side to accommodate a set of the upper and lower pistons 25, 25 and a set of connecting rods 26, 26 adjoining each other in an axial direction of the crankshaft 9, and another set of upper and lower cylinders 24*c* and 24*d* arranged on a right side to accommodate another set of the upper and lower pistons 25, 25 and another set of connecting rods 26, 26 adjoining each other in the axial direction of the crankshaft 9. Thus, the two sets of cylinders are developed into the V-shape in a rearward direction and arranged in a zigzag manner with the left cylinders 24*a* and 24*b* located at elevation levels higher than those of the right cylinders 24*c* and 24*d*. Such an arrangement of the cylinders ensures that the lateral width of the engine block subassembly 20 can be decreased to reduce the size of the engine 7, as compared with other V-shaped engines.

FIG. 4 shows the cylinder 24 disposed on the left side of the outboard engine system (i.e., on a lower side in FIG. 4). As shown in FIG. 4, intake passages 28 are provided in the cylinder head 21 in correspondence to the cylinders 24. The intake passages 28 lead to the corresponding cylinders 24 through intake valves 29 and open at their other ends into a side of the cylinder head 21. An intake pipe 30 is connected to each of the openings of the intake passages 28 and extends along a side of the engine block subassembly 20 toward a crank chamber positioned ahead of the intake pipe 30. The intake pipes 30*c* and 30*d* shown in FIG. 2 are intake pipes corresponding to the cylinders 24*c* and 24*d* shown in FIG. 5, while the intake pipes 30*a* and 30*b* shown in FIG. 3 are intake pipes corresponding to the cylinders 24*a* and 24*b* shown in FIG. 5.

Surge tanks 31L and 31R are mounted on left and right opposite sides of a front portion of the engine block subassembly 20. The intake pipes 30*a* and 30*b* communicate with the surge tank 31L, while the intake pipes 30*c* and 30*d* communicate with the surge tank 31R. A throttle body 32, having a throttle valve 32V therein, is disposed at a front and substantially laterally central portion of the engine block subassembly 20. The throttle body 32 and the surge tanks 31L and 31R communicate with each other through an elbow which is in the form of air passages 33 which laterally diverge from the throttle body 32. Air is introduced from above into the throttle body 32 via an intake silencer 34 which includes left and right air intake pipes 34L and 34R, an intake silencing chamber 34V and a central intake-air introducing pipe 34C.

The left and right air passages 33, 33 are shaped laterally symmetrically and hence, the lengths of the air passages 33, 33 from the throttle body 32 to the surge tanks 31L and 31R are set to be substantially equal to each other. The left and right surge tanks 31L and 31R are also disposed at laterally symmetric locations on opposite sides of the engine block subassembly 20. Therefore, the length of each of the two left intake pipes 30*a* and 30*b* and the length of each of the two right intake pipes 30*c* and 30*d* are set to be substantially equal to each other.

The air introduced from above through the intake-air introducing pipe 34C is controlled in flow rate within the throttle body 32, and is then dispensed to the left and right surge tanks 31L and 31R and supplied as a burning air from the surge tanks 31L and 31R through the intake pipes 30*a*, 30*b*, 30*c* and 30*d* into the respective cylinders 24, while fuel is injected from fuel injecting valves 35 and mixed with the air in the intake ports 28 (see FIG. 4).

In FIG. 2, reference character 32*a* is a throttle valve shaft; reference character 32*b* is a link member; and reference character 32*c* is a fastener made of a rubber or the like, which is mounted between a locking portion, having a small hole, provided on the intake silencer 34 and a locking portion, having a notched fine groove, provided on the air passage 33. In FIG. 3, reference character 32*d* is a throttle opening degree sensor, and reference character 33*b* is an intake air temperature sensor. The throttle body 32 and the air passage 33 are coupled to each other by a bolt 32*e*. The throttle body 32 and the intake silencer 34 are coupled to each other by the fastener 32*c*. The air passage 33 and the crankcase 20*b* are coupled to each other by a bolt 33*c*.

The pair of left and right air passages 33 are connected to the pair of left and right surge tanks 31L and 31R through connections 33*a*. The volume areas of the surge tanks 31L and 31R extend both higher and lower than the connections 33*a* as shown in FIG. 2. The volume of the volume area is set as required, but a portion of the volume area, which is located below the connection 33*a*, is located outside a flow of air from the connection 33*a* to a connected portion of each intake pipe 30. Therefore, that portion of the volume area also functions as a water-separating chamber when water enters an intake system. Reference character 31*d* is a drain bolt.

Fuel is supplied from a fuel tank (not shown) mounted on a boat. As shown in FIG. 2, a fuel receiving pipe 37, which is mounted in the outboard engine system, is connected to the fuel tank. The fuel supplied through the fuel receiving pipe 37 is initially stored in a vapor-fuel separator 42 while being limited by a float 41, and is then supplied via a strainer 43, a high-pressure pump 44, a high-pressure filter 45 and pipes 38 and 39 to the fuel injecting valves 35. These devices and the pipes in the outboard engine system are disposed on the right side of the engine 7, as shown in FIG. 2. The high-pressure pump 44 may be disposed within or outside the vapor-fuel separator 42.

Figure 6:
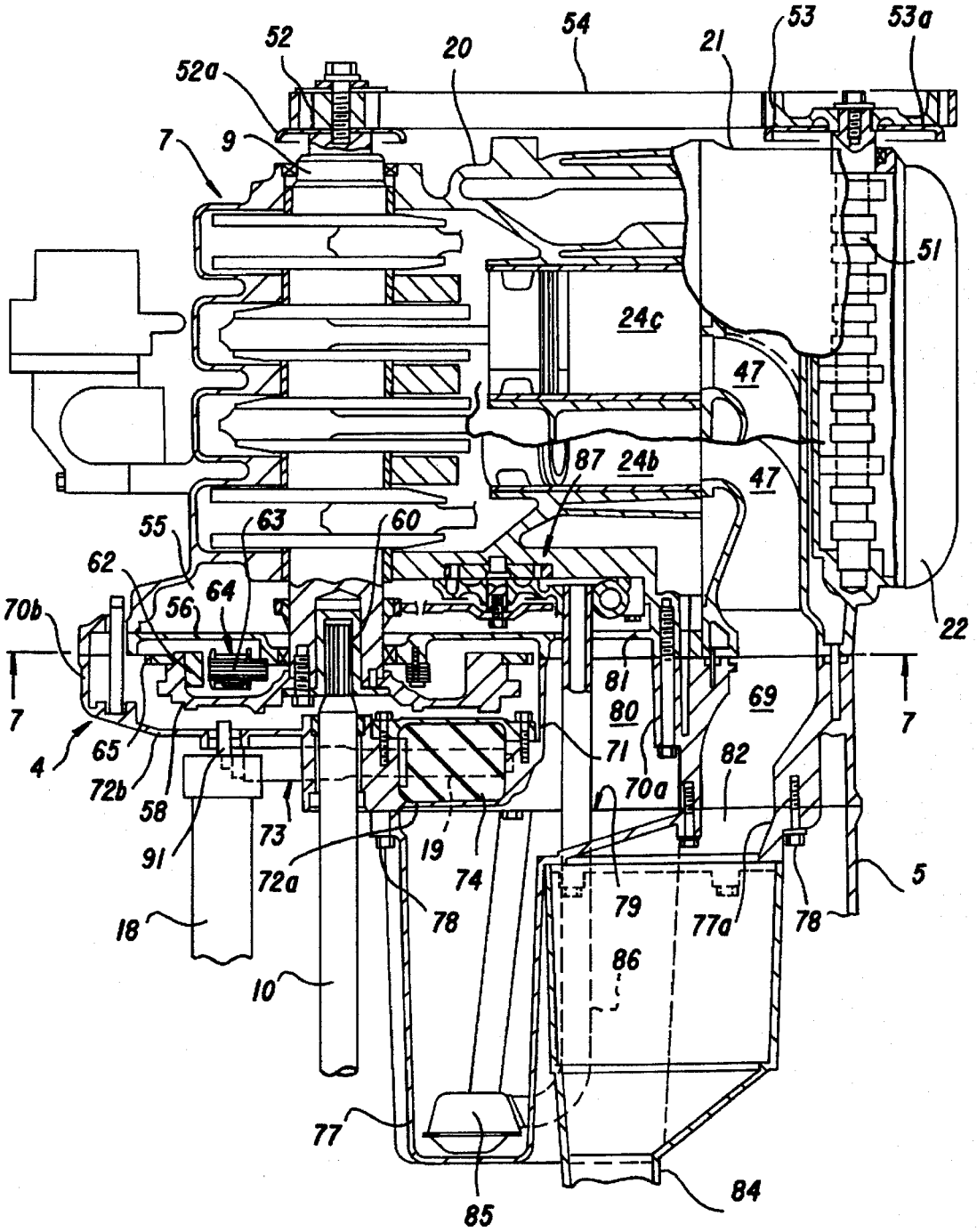
FIG. 6 is a longitudinal sectional view of the engine.

FIG. 6 is a longitudinal sectional view of the engine 7 taken along various sections including an axis of the crankshaft 9, wherein the section of the cylinder 24*c* and a portion of the section of the cylinder 24*b* are shown in FIG. 6.

As can be seen from FIGS. 4 and 6, exhaust passages 47L and 47R and an exhaust valve 46 are provided below the intake passage 28 and the intake valve 29 for each of the cylinders 24. The exhaust passages 47R connected to the exhaust valves 46 for the right cylinders 24*c* and 24*d*, and the exhaust passages 47L connected to the exhaust valves 46 for the left cylinders 24*a* and 24*b* extend downwardly along a widthwise central portion of the cylinder head 21, i.e., between the right cylinders 24*c* and 24*d* and the left cylinders 24*a* and 24*b*, and join with each other at a lower end and open into a lower surface of the cylinder head 21.

In FIGS. 2 to 4, reference character 36 is an igniter mounted for each of the cylinders 24*a*, 24*b*, 24*c* and 24*d*. The igniter 36 is composed of an ignition coil 36*a*, a cap 36*b* and a spark plug 36*c*.

As shown in FIG. 3, a starter motor 48 is mounted on the left side of the engine block subassembly 20 such that an output shaft 49 of the starter motor 48 protrudes downwardly. A driving gear 50 is mounted on the output shaft 49. The driving gear 50 is meshed with a ring gear integrally formed around an outer periphery of a flywheel which will be described hereinafter.

As shown in FIG. 6, the crankshaft 9 is vertically directed as described above, and a camshaft 51 is disposed in the cylinder head 21 in parallel to the crankshaft 9. Upper ends of the crankshaft 9 and the camshaft 51 protrude upwardly through the engine block subassembly 20 and the cylinder head 21, respectively. A driving pulley 52 and a follower pulley 53 are fixedly mounted at these upper ends, respectively, and a belt 54 is wound around the pulleys 52 and 53. Thus, the camshaft 51 is driven through the belt 54 by the crankshaft 9. Since the engine 7 is a 4-cycle engine, the diameter of the follower pulley 53 is set at a value twice as large as the diameter of the driving pulley 52 in order to set the rotational ratio of the crankshaft 9 to the camshaft 51 at 2:1. Each of reference characters 52*a* and 53*a* is a controlling pick-up plate.

The lower surface of the engine block subassembly 20 has an opened portion 55. A lower wall of the engine block subassembly 20 is formed by a closing plate 56 which closes the opened portion 55 in a sealing manner. The closing plate 56 is detachably secured to the engine block subassembly 20 by bolts 57 (see FIGS. 2 and 3). A lower end of the crankshaft 9 rotatably passes through the closing plate 56 to protrude downwardly. A flywheel 58 is secured to the lower end of the crankshaft 9. A dynamo 64 is mounted inside the flywheel 58, and includes a rotor 62 fixed on the side of the flywheel 58 and a stator 63 fixed on the side of the closing plate 56.

A ring gear 65 is integrally formed around an outer periphery of the flywheel 58 by shrink-fitting or the like. The ring gear 65 is meshed with the driving gear 50 mounted on the output shaft 49 of the starter motor 48 (see FIG. 3) on the left side of the engine block subassembly 20. At the start of the engine, the crankshaft 9 is driven by the starter motor 48.

The engine mount case 4 is clamped and coupled along with the closing plate 56 to a lower surface of the engine block subassembly 20 by the bolts 57 with the closing plate 56 interposed between the engine mount case 4 and the lower surface of the engine block subassembly 20. The engine mount case 4 extends rearwardly, i.e., to the cylinder head 21 and is also coupled to that lower surface of the cylinder head 21 into which the exhaust passages 47L and 47R open.

The engine mount case 4 includes peripheral walls 70*a* and 70*b* extending downwardly from connected faces between the engine mount case 4 and the closing plate 56 via packing, and an enclosure wall 71 extends downwardly from the connected faces (see FIG. 6). Both of the peripheral walls 70*a* and 70*b* and the enclosure wall 71 extend to locations below the flywheel 58. The flywheel 58 is surrounded by the peripheral wall 70*b* and the enclosure wall 71. Further, a bottom plate or wall 72*a* continuously formed with a lower end of the peripheral wall 70*a*, and a bottom plate or wall 72*b* continuously formed with the peripheral wall 70*b*, extend to locations below a central portion of the flywheel 58. The height (i.e., the depth) of the peripheral wall 70*b*, as measured downwardly from the connected faces, is lower than the height (i.e., depth) of the peripheral wall 70*a*. Therefore, the bottom plates 72*b* and 72*a* superpose with each other at a vertical distance below the central portion of the flywheel 58. A mounting opening 73, which opens forwardly, is formed at the superposed portion.

The driving shaft 10, for transmitting the rotation of the crankshaft 9 to the propeller 13, is pivotally supported at the bottom plate **72*b* and 72*a* and vertically passes through the opening 73. An upper end of the driving shaft 10 is inserted from below into a collar member 60 to spline-engage the latter. The collar member 60 is fitted into the crankshaft 9**.

The connecting member 19, for interconnecting the swivel shaft 18 and the engine mount case 4, is also inserted from the front into the opening 73. The connecting member 19 includes two left and right connecting rods 19L and 19R (see FIGS. 2 and 3) extending in a longitudinal direction on opposite sides of the driving shaft 10. Tip ends of the connecting rods 19L and 19R are connected to the engine mount case 4 through a rubber mount 74.

A peripheral edge of an upper end of an oil pan 77 is fastened to the lower surface of the engine mount case 4 by a bolt 78. An opening 79 is provided in an upper surface of the oil pan 77 and communicates with an interior of the engine block subassembly 20 through an oil communication passage 80 formed in the engine mount case 4 and through an opening 81 provided in the closing plate 56, so that oil which is returned from a cam chamber and a crank chamber and accumulated on the closing plate 56 flows through the oil communication passage 80 and is dropped through the opening 79 into the oil pan 77. However, the oil on the closing plate 56 cannot enter a portion of the flywheel 58 which is surrounded by the peripheral wall **70*b* and the enclosure wall 71, because the opening 81 is provided in the enclosure plate 56 on the opposite side from the flywheel 58 with respect to the enclosure wall 71**.

A portion of a flange of the oil pan 77 is extended to form an exhaust pipe portion **77*a*. The exhaust pipe portion 77*a* is integrally formed at an upper portion of the oil pan 77 to protrude rearwardly. An exhaust passage 82 is formed in the exhaust pipe portion 77*a* and communicates 5 with the exhaust passage 69 in the engine mount case 4. The exhaust passage 82 communicates with a catalytic converter 83 which is juxtaposed outside the oil pan 77. An exhaust gas purified in the catalytic converter 83 flows through the exhaust pipe 84 and is discharged through a lower portion of the body case 6 into the water. The oil stored in the oil pan 77 is drawn via a strainer 85 and a suction pipe 86 into an oil pump 87** and is supplied to various portions of the engine.

The disposition of the oil filter 94 will be described below with reference to FIGS. 3, 5 and 7.

Figure 7:
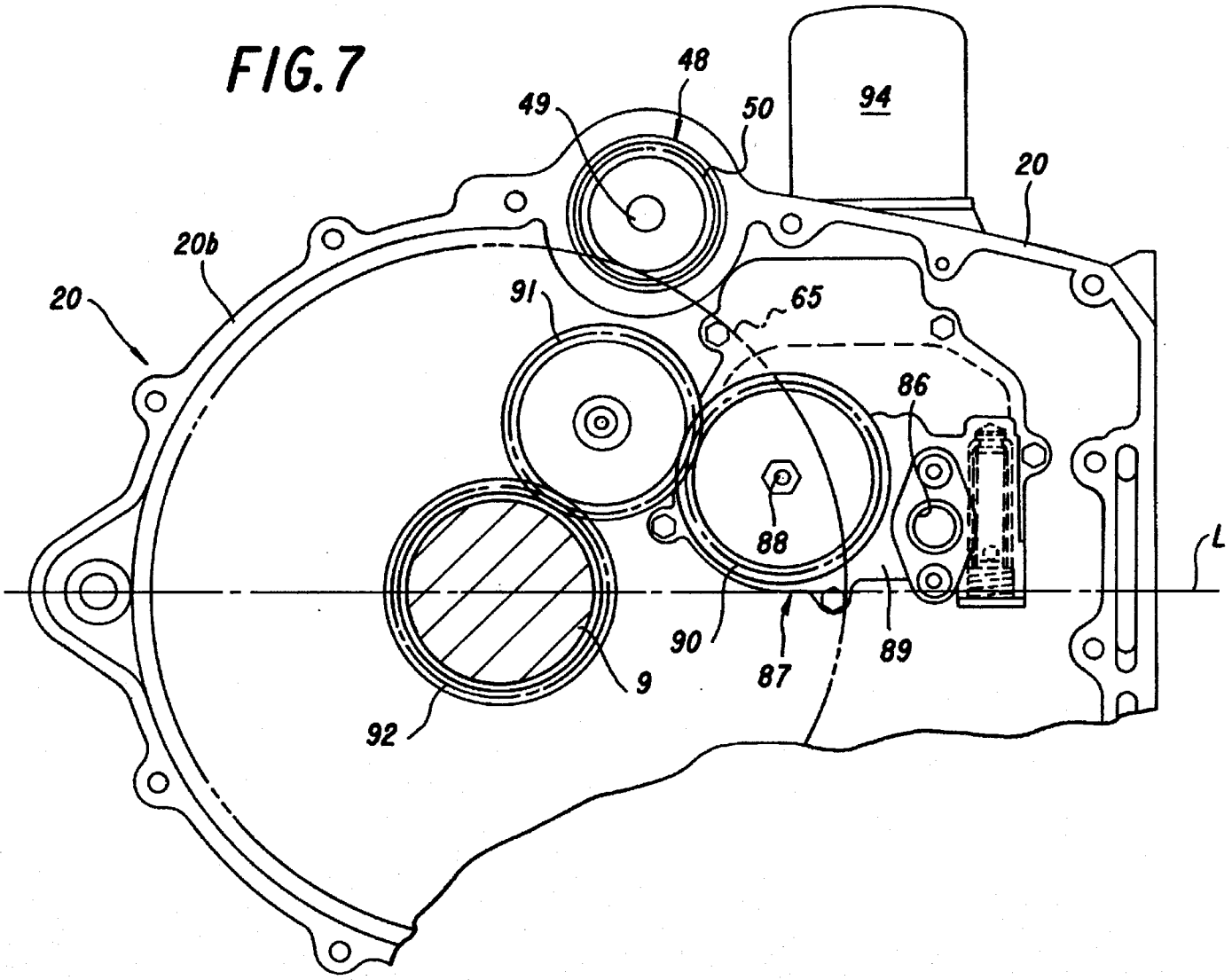
FIG. 7 is a view taken in a direction indicated by 7 in FIG. 6.

FIG. 7 is a view of the cylinder block **20*a* and the crankcase 20*b* taken in the direction indicated by 7 in FIG. 6. The oil pump 87 is disposed at a location near the longitudinally centerline L on the left side of the lower portion of the cylinder block 20*a*. This location corresponds to a location below the cylinder 24*b*. Thus, as shown in FIG. 5, the left cylinders 24*a* and 24*b* are disposed at elevation levels higher than those of the right cylinders 24*c* and 24*d* and space is created below the cylinder 24*b*. The oil pump 87** is disposed in this space.

The oil pump 87 has a rotor shaft 88, which rotatably passes through a pump casing 89, protrudes downwardly. A driven gear 90 is fixedly mounted at a lower end of the rotor shaft 88. The driven gear 90 is meshed with an intermediate gear 91 which is meshed with a driving gear 92 fixedly mounted on the crankshaft 7. Thus, the oil pump 87 is driven through gears 92, 91 and 90 by the crankshaft 7.

Oil discharged from the oil pump 87 is introduced through an oil passage **87*a* (see FIG. 5) to the oil filter 94 mounted in the vicinity of the oil pump 87, and is filtered in the oil filter 94. The oil is then supplied to portions to be lubricated such as a main bearing of the crankshaft 7, a valve operating chamber within the cylinder head 21 and the like. The oil, after lubricating such portions to be lubricated, is returned to the oil pan 77. Because both the oil filter 94 and the oil pump 87 are mounted on the same side (left side) of the cylinder block 20*a* in the above manner, the oil filter 94 and the oil pump 87** can be disposed in proximity to each other to easily form the oil passage interconnecting both of them.

In FIG. 5, each of reference characters 95, 95 is a breather passage; reference character 96 is an opening of the oil passage which permits the lubricating oil passed through the oil filter 94 to be supplied from the engine block subassembly 20 into the cam chamber in the cylinder head 21; and reference character 97 is a lubricating-oil return passage which communicates with the cam chamber.

As can be seen from FIG. 3, the starter motor 48, the oil filter 94 and the two intake pipes **30*a* and 30*b* are disposed on the left side of the cylinder block 20*a*. The lower intake pipe 30*b* is disposed to traverse between the starter motor 48 and the oil filter 94. The oil filter 94 is disposed in the space defined between the upper and lower intake pipes 30*a* and 30*b***.

As apparent from a comparison of FIG. 3 with FIG. 2, the level of the lower intake pipe **30*b* on the left side is at a location higher than that of the lower intake pipe 30*d* on the right side, because the left cylinders 24*a* and 24*b* are disposed at locations higher in elevation than those of the right cylinders 24*c* and 24*d*. As a result, the starter motor 48 can be laid-out by utilizing the wasted space defined below the lower intake pipe 30*b* on the left side. The oil filter 94, disposed between the two intake pipes 30*a* and 30*b*, is at a location higher in elevation than the upper edge of the under-case portion 6*a* (see FIG. 3). Therefore, the mounting and removal of the oil filter 94 can easily be performed without being impeded by the undercase portion 6*a***.

The engine 7 in the embodiment includes the two intake pipes **30*a* to 30*d*** on each of the left and right opposite sides, but the number of the intake pipes is not limited to the number in the embodiment.

The flywheel 58 has been mounted at the lower end of the crankshaft 9 in the embodiment, but the flywheel 58 may be mounted at the upper end of the crankshaft 9 above the driving pulley 52. In this case, attention should be paid so that the upper end of the intake silencer 34 does not interfere with the flywheel 58, but it is possible to assure the volume of the intake silencer 34 by a space corresponding to the height of the belt 54 which is wound around the driving pulley 52 below the flywheel 58.

Independent cylinder heads may be provided in left and right banks of the engine 7, respectively. The oil filter 94 is mounted at the upper portion of the lower intake pipe **30*b* in this embodiment, but the oil filter 94 may be mounted at the upper end of the upper intake pipe 30*a***.

Further, instead of disposing the intake silencer 34, the throttle body 32 and the air passage 33 in the named order from above to below, they may be disposed in the named order from below to above.

Although the embodiment of the present invention has been described in detail, it will be understood that the present invention is not limited to the above-described embodiment, and various modifications in design may be made without departing from the spirit and scope of the invention defined in claims.

What is claimed is:

1. An engine for an outboard engine system, comprising:

an engine block subassembly for supporting a crankshaft in a vertical attitude, and having a plurality of cylinders formed therein into a V-shape to open rearwardly from said crankshaft;

a cylinder head coupled to a rear end of said engine block subassembly;

a throttle body disposed in front of said engine block subassembly;

a starter motor mounted at a lower portion of said engine block subassembly on one side thereof for driving said crankshaft;

an oil filter mounted above said starter motor; and a plurality of intake pipes extending from said throttle body through left and right opposite sides of said engine block subassembly and connected to said cylinder head, at least one of said plurality of intake pipes is disposed such as to extend between said starter motor and said oil filter.

2. An engine for an outboard engine system according to claim 1, further including an under-case portion for covering a lower half of said engine block subassembly, and an engine cover which is detachably coupled to an upper edge of said under-case portion to cover an upper half of said engine block subassembly, and wherein said oil filter is detachably mounted at a location higher in elevation than the upper edge of said under-case portion.

3. An engine for an outboard engine system according to claim 1, wherein said plurality of cylinders are vertically superposed and alternately distributed to left and right opposite sides of said cylinder block subassembly, a second cylinder from a bottom being formed in said one side of said engine block subassembly.

4. An engine for an outboard engine system according to claim 3, further including an oil pump disposed below the second cylinder from the bottom for supplying a lubricating oil to said oil filter.

5. An engine for an outboard engine system, comprising:

an engine block subassembly for supporting a crankshaft in a vertical attitude, and having a plurality of cylinders formed therein into a V-shape to open rearwardly from said crankshaft;

a cylinder head coupled to a rear end of said engine block subassembly;

a throttle body disposed in front of said engine block subassembly;

a plurality of intake pipes extending from said throttle body through left and right opposite sides of said engine block subassembly and connected to said cylinder head; and an oil filter which is disposed between two adjacent intake pipes of said plurality of intake pipes which are disposed on one side of said engine block subassembly.

6. An engine for an outboard engine system according to claim 5, further including an under-case portion for covering a lower half of said engine block subassembly, and an engine cover which is detachably coupled to an upper edge of said under-case portion to cover an upper half of said engine block subassembly, and wherein said oil filter is detachably mounted at a location higher in elevation than the upper edge of said under-case portion.

7. An engine for an outboard engine system according to claim 5, wherein said plurality of cylinders are vertically superposed and alternately distributed to left and right opposite sides of said cylinder block subassembly, a second cylinder from a bottom being formed in said one side of said engine block subassembly.

8. An engine for an outboard engine system according to claim 7, further including an oil pump disposed below the second cylinder from the bottom for supplying a lubricating oil to said oil filter.

9. An engine for an outboard engine system, comprising:

an engine block subassembly for supporting a crankshaft in a vertical attitude, and having a plurality of cylinders formed therein into a V-shape to open rearwardly from said crankshaft;

a cylinder head coupled to a rear end of said engine block subassembly;

a throttle body disposed in front of said engine block subassembly;

a plurality of intake pipes extending from said throttle body through left and right opposite sides of said engine block subassembly and connected to said cylinder head;

an under-case portion for covering a lower half of said engine block subassembly;

an engine cover which is detachably coupled to an upper edge of said under-case portion to cover an upper half of said engine block subassembly; and an oil filter which is detachably mounted at a location higher in elevation than the upper edge of said under-case portion on one side of said engine block subassembly and higher in elevation than the lowermost intake pipe disposed on said one side of said engine block subassembly.

10. An engine for an outboard engine system according to claim 9, wherein said plurality of cylinders are vertically superposed and alternately distributed to left and right opposite sides of said cylinder block subassembly, a second cylinder from a bottom being formed in said one side of said engine block subassembly.

11. An engine for an outboard engine system according to claim 10, further including an oil pump disposed below the second cylinder from the bottom for supplying a lubricating oil to said oil filter.

* * * * *